US005788073A

United States Patent [19]

Suryk

[11] Patent Number: 5,788,073

[45] Date of Patent: Aug. 4, 1998

[54] SHOPPING ORGANIZER

[76] Inventor: Kaye Suryk, 34 Sarah Ave., Springfield, Ill. 62703-5335

[21] Appl. No.: 816,958

[22] Filed: Nov. 7, 1996

[51] Int. Cl.[6] ..... B65D 85/00

[52] U.S. Cl. ..... 206/425; 206/818; 206/459.5

[58] Field of Search ..... 206/818, 425, 206/232, 459.5, 223, 472, 473, 214, 449

[56] References Cited

U.S. PATENT DOCUMENTS

| | | | |
|---|---|---|---|
| 3,068,923 | 12/1962 | Wolf | 206/425 |
| 4,004,690 | 1/1977 | Giarritta . | |
| 4,260,055 | 4/1981 | Slaybaugh . | |
| 4,318,471 | 3/1982 | Hutton | 206/214 |
| 4,463,848 | 8/1984 | Parker . | |
| 4,591,054 | 5/1986 | Blossom . | |
| 4,716,948 | 1/1988 | Brissette | 206/214 |
| 4,802,575 | 2/1989 | Martin . | |
| 4,932,520 | 6/1990 | Ciarcia et al. . | |
| 5,170,889 | 12/1992 | Cue . | |
| 5,274,937 | 1/1994 | Birnbaum | 206/818 |
| 5,320,275 | 6/1994 | Williams . | |
| 5,664,724 | 9/1997 | Ho | 206/425 |

*Primary Examiner*—Paul T. Sewell
*Assistant Examiner*—Nhan T. Lam
*Attorney, Agent, or Firm*—Polster, Lieder, Woodruff & Lucchesi, LC

[57] ABSTRACT

A shopping organizer for organizing a shopping trip to a grocery store. A shopping organizer a first rectangular panel and a second rectangular panel. The first panel includes an inner layer formed from a flexible flat rubberized magnet material. The second panel can include an inner layer constructed of a substantial paperboard or cardboard. The first panel also includes, on the inside surface, an envelope frame, preferably formed from transparent plastic or the like, for the removable insertion of a preprinted envelope. The organizer includes a plurality of envelopes sized and configured to seat in the envelope frames. The envelopes include a preprinted exterior surface that is printed with a check-off list of popular grocery items. When inserted in the envelope frame, the list is exposed for marking by the user. The list of items can be customized to conform to the aisle arrangement of a particular grocery store. The second panel includes a plurality of pockets, in assorted sizes, formed in the cover material for the removable storage of bank cards, money or other substantially flat items. A small writing tablet can be included on one comer the inner face of the second panel. The inner surface of the hinge includes a loop to hold a pencil or other writing instrument.

15 Claims, 1 Drawing Sheet

SHOPPING ORGANIZER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates generally to a secretarial device and, in particular to a shopping organizer that allows the user to efficiently shop in a store, particularly in a grocery store.

Trips to a grocery store to purchase food and other products can be time consuming and often frustrating for consumers, particularly those consumers who do not make regular shopping visits and who are unfamiliar with the general layout of the store. Often a shopper's time in consumed by hunting for product among the various aisles and shelves and by back-tracking to find missed items.

Many grocery shoppers go to the store with a shopping list in hand. However, maintaining a grocery list can be tedious. Often the consumer fails to write a product down or, on the other hand, writes down such a large number of items that the list requires revision or rewriting. Further, the listing of items generally bears no relationship to their location in the store. That is, despite having a list, a shopper often must hunt for a listed item or back track to find an item on the list. Many times the product hunt and back tracking results in impulse buying which can significantly increase the shopper's grocery bill.

In addition to the grocery list, many consumers save coupons which are used to reduce the price of a purchased item. The coupons often are clipped from a newspaper or magazine or otherwise provided as a relatively small slip of paper or cardboard. The consumer generally stores the coupons with the grocery list. However, coupons can be lost or ruined if kept loose. Several prior art inventions are directed to the problem of organizing and storing coupons. For example, U.S. Pat. No. 4,004,690, to Giaritta, discloses a coupon holder which appears to include a plurality of discrete folders. U.S. Pat. No. 4,260,055, to Slaybaugh provides a kit for clipping, sorting and redeeming coupons. Parker, in U. S. Pat. No. 4,463,848 provides a rather elaborate case for collecting, carrying and organizing coupons. U.S. Pat. No. 4,951,054, to Blossom, discloses a combination purse-coupon organizer device. Likewise, Martin's U.S. Pat. No. 4,802,575 also provides a food store coupon organizer. U.S. Pat. No. 5,170,889, to Cue, provides a coupon caddy for wall and pocket use having a hanging grommet and a accordion-style open pocket including a plurality of individual dividers.

Although the prior art patents appear to address the general problem of storing coupons, they all have similar short-comings. For example, many of the prior art devices appear to be complex and oft-times cumbersome in construction and use. Moreover, they do not address problems recognized by the instant inventor. That is, no prior art devices address the overriding problem of shopping efficiency beyond the collection and storage of coupons. Although some prior art devices may address the problem of efficiently handling coupons, none address the problem of organizing the overall grocery shopping experience.

BRIEF SUMMARY OF THE INVENTION

It is among the primary objects of the present invention to provide an organizer that allows a shopper to more efficiently shop in a grocery store.

Another object of the invention is to provide such an organizer that can be conveniently displayed in the user's kitchen for ease of access.

It is another object of the invention to provide such an organizer that includes a preprinted list of popular items that can be checked off in lieu of a grocery list.

Still another object of the invention is to provide such an organizer that has the preprinted list of popular items arranged on the list according to location in the aisles of a grocery store to prevent back-tracking as the shopper progresses through the grocery store.

Yet another object of the invention is to provide such an organizer wherein the preprinted list of popular items is configured as removable envelope for the storage of coupons and the like.

Still another object of the invention is to provide such an organizer including a pencil and a firm writing surface so as to provide convenient means for marking items on the preprinted list.

A further object of the invention is to provide such an organizer having a plurality of storage slots for credit cards, bank cards or other items.

Yet another object of the invention is to provide such an organizer that can be constructed like a foldable wallet with closure having an external appearance of a wallet or other secretarial device.

Another object of the invention is to provide such an organizer that can be customized with the logo of a particular grocery store and an item list corresponding to the aisle plans of that store which can be provided to customers of the store as an advertising premium.

In accordance with the invention generally stated, a shopping organizer a first rectangular panel and a second rectangular panel. The panels are covered by a flexible, durable material such as vinyl or leather and are connected along one edge by a flexible hinge formed from the cover material. The panels and the hinge thus have a contiguous aesthetically pleasing cover. The first and second panels include opposed fastening structures such as a snap or Velcro to releasably secure the panels in a folded or closed position.

The first panel includes an inner layer formed from a generally rectangular, slightly flexible flat rubberized magnet material. The second panel can includes an inner layer constructed of a substantial paperboard or cardboard to maintain the general shape of the second panel. The first panel includes, on the inside surface, an open-sided envelope frame, preferably formed from transparent plastic or the like, for the removable insertion of a preprinted envelope. The second panel includes, on the inner surface, a plurality of pockets, in assorted sizes, formed in the cover material for the removable storage of bank cards, money or other substantially flat items. A small writing tablet can be included on one comer the inner face of the second panel. The inner surface of the hinge includes a loop to hold a pencil or other writing instrument.

The organizer includes a plurality of envelopes sized and configured to seat in the envelope frames. The envelopes include a preprinted exterior surface that is printed with a check-off list of popular grocery items. When inserted in the envelope frame, the list is exposed for marking by the user. The list of items can be customized to conform to the aisle arrangement of a particular grocery store.

In use, the organizer can be opened so that the inner surfaces of both panels are exposed. The flat magnet in the first panel allows the organizer to be removably attached to a refrigerator and also provides a firm, flat writing surface. A clean envelope is placed in the envelope frame with the preprinted list exposed. The user then can check off items or enter quantity numbers next to a particular item on the envelope. Also, coupons are placed in the envelope as accumulated. For a shopping trip, the user can remove the entire organizer from the refrigerator, fold it to a closed position and fasten the snap or Velcro® enclosure. At the grocery store, the user can follow the preprinted list and efficiently shop. At the grocery checkout, the user's coupons, bank cards, and money are conveniently at hand. Upon return home, a clean envelope is exposed by removing the used envelope or inserted from a supply and the organizer is ready for the next shopping trip. Alternatively, the user can pull the marked envelope from the organizer and take only the marked envelope to the grocery store if the entire organizer contents are not needed.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 2:
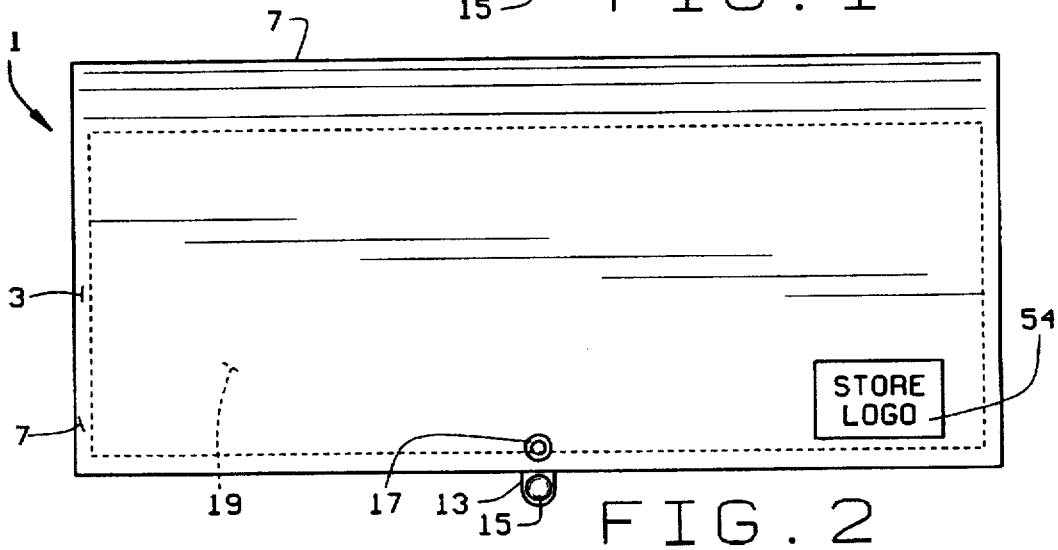
FIG. 2 is a top plan of the shopping organizer of the present invention in a closed position.

The shopping organizer of the present invention is indicated generally in the drawings by reference numeral 1. The preferred embodiment of organizer 1 includes a first panel 3 and a second panel 5. Panels 3 and 5 have the general overall configuration and dimensions of slightly larger than either a personal or business envelope. Panels 3 and 5 are covered inside and out with a contiguous cover 7 formed from a flexible, aesthetically pleasing, durable material as vinyl, plastic or leather. The contiguous cover material creates a flexible hinge 9 of cover material. It will be appreciated that panels 3 and 5 can be separately covered and joined by another type of hinge such as a convention metal hinge or discrete flexible material hinges without departing from the scope of the invention. In the illustrated embodiment panel 5 includes a tab 13 with one half of a conventional clasp 15 while panel 3 includes the opposite half of the clasp 17. Organizer 1 can be folded along hinge 9 to a closed position, as shown in FIG. 2, and secured in the closed position by engaging the clasp. It will be appreciated, however, that any acceptable clasp or closure structure is envisioned by the inventor. For example, the respective panels could include a Velcro® enclosure mechanism. In any event, any effective closure to secure the contents of organizer 1 between the two panels will suffice.

Turning now to a detailed description of panel 3 and its elements, it will be understood that panel 3 includes a substantially hard and relatively inflexible inner layer 19, as shown in FIG. 2. In the preferred embodiment, inner layer 19 is a rectangular insert approximately of the dimensions as panel 3 formed from a rubber or plastic material having magnetic properties associated therewith. Layer 19 can serve two functions. First, the magnetized inner layer allows organizer 1 to be removably attached to an attracted or magnetic metal surface, for example, to the front of a refrigerator or metal cabinet or other relatively flat surface so that the organizer can be hung in the kitchen in any other convenient location. Further, layer 19 functions as a hard writing surface to facilitate writing on the preprinted list that will be explained below.

Panel 3 also includes, on its inside surface 21 an envelope frame 23. Envelope frame 23 has a pair of side members 25, 27 and a bottom member 29. Frame 23 is open at the top. However, the frame could be open on one end rather than the top to allow the insertion of the envelope. The respective members preferably can be formed as one contiguous structure from strips of transparent flexible vinyl or plastic that are attached to the inside surface of the panel along one edge leaving one edge open to allow an envelope to seat between the frame member and the panel. Frame 23 is dimensioned to accommodate an envelope, as will be described below. It will be appreciated that frame 23 can be constructed from other materials such as metal strips or semi-rigid plastic or the like as long as the members of frame 23 allow the insertion of a envelope, as will now be described in detail.

Frame 23 is designed to removably secure an envelope, as indicated generally by reference numeral 30. Envelope 30 is of appropriate dimension to fit in frame 23. The size of the envelope depends upon the overall size of organizer 1 and can be the same size as a conventional personal or business size envelope. Envelope 30 has a plurality of printed indicia 32 on at least one surface. The indicia can be referred to as a preprinted shopping list. In the preferred embodiment, the indicia include a list of commonly purchased grocery items. The term "grocery items" is intended to include any and all items purchasable at a full line grocery store and is not limited to food items. For example, grocery items may include cleaning supplies, toiletries and so on. Further, the items on the list may be changed periodically to reflect a change in demand or popularity of items. The printed indica 32, as shown, are intended to be illustrative and do not represent the only items that can be listed. The printed indicia also include spaces 34 for the ad lib entry of items. Further, the indicia are preceded by blanks 36 for the entry of quantity numbers or other indicators. When secured in frame 23, the indicia 32 are exposed so that the user can make entries or notations. Further, it will be appreciated by those skilled in the art, that the arrangement of the indicia 32 on envelope 30 can be customized to correspond to the aisle arrangement of those items in a particular grocery store. That is, the listing of the indicia 32 on the envelope will, for the most part, allow the user to proceed down the aisles in a grocery store and find the items listed on the envelope in order without backtracking in the store, thus allowing the user to shop in a more efficient manner. Further, the user can insert coupons in envelope 30 as they are accumulated. The user also can make an identifying mark on the indicia if he or she has a coupon for an item on the list. It will be appreciated that a plurality of envelopes can be provided with organizer 1. The plurality of envelopes can be stored in frame 23. As the envelope is used, it can be removed and discarded and a clean enveloped exposed. Of course, envelopes can be stored remote from the organizer.

Figure 1:
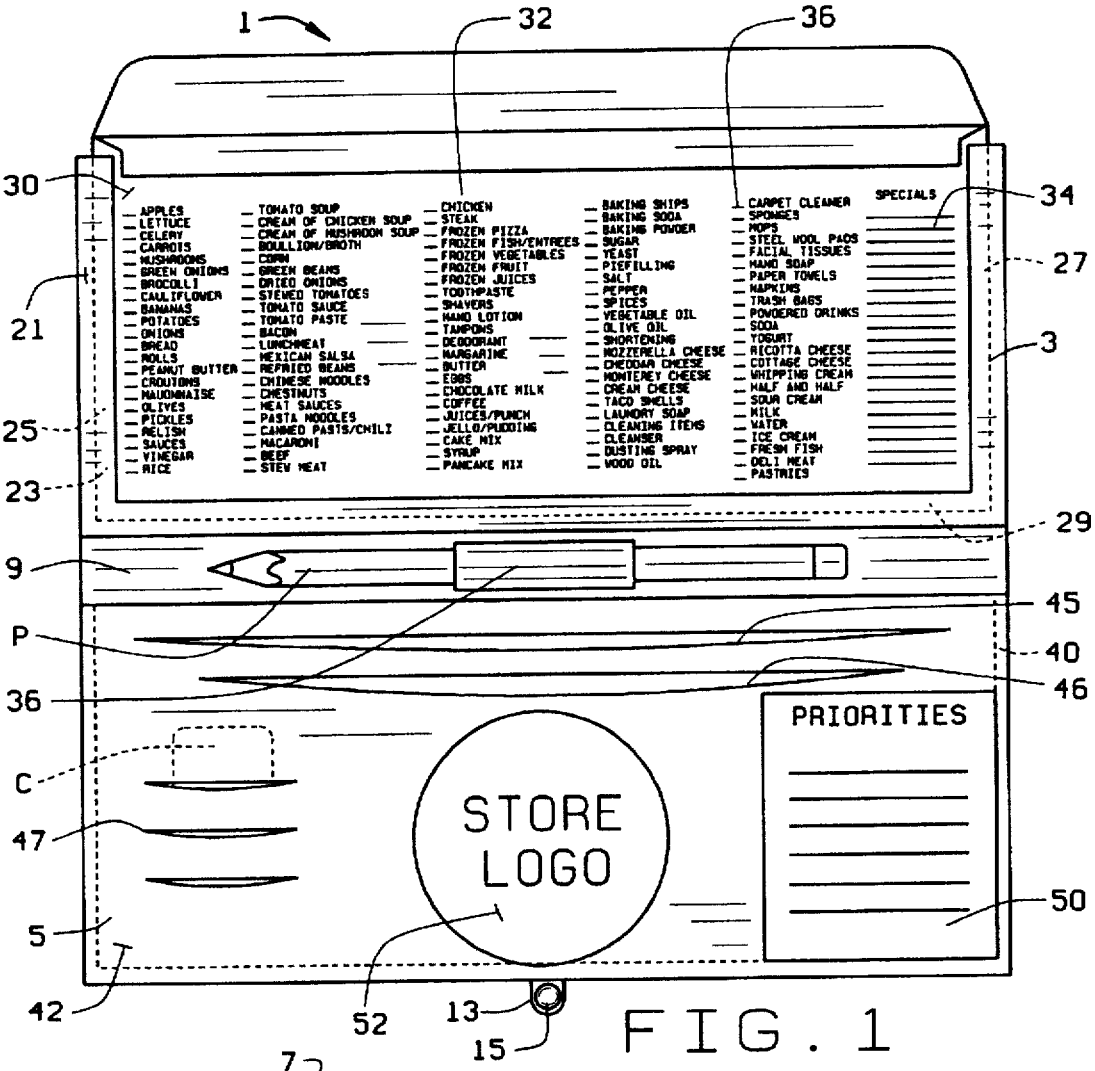
FIG. 1 is a front view of the shopping organizer of the present invention in an opened position.

To facilitate the marking of items on envelope 30, organizer I also includes a loop 36 formed from cover material for the insertion of a pencil P or pen or other appropriate writing instrument. When the organizer is in an open position, as shown in FIG. 1, the pencil is readily accessible.

Panel 5 is constructed in a manner similar to panel 3. Panel 5 also can have an inner layer 40 formed from a relatively inflexible material such as cardboard or the like. It is not necessary for layer 40 to be formed from a magnetized material. However, layer 40 can be a magnetized layer without departing from the scope of the invention. Panel 3 includes an inside surface 42. The inside surface can include a series of elongated slots or storage pockets 45, 46. Pockets 45, 46 can be used for the storage of currency, supplemental notes or other items. Inside surface 42 also includes a series of shorter slots, as at 47, to removably secure a bank card C, check cashing card or the like. In the preferred embodiment, panel 5 also includes a small note pad 50 having a plurality of removable sheets that can be used for making notes and so forth. The note pad 50 can be affixed to the panel by an adhesive or, preferably, by sliding a cardboard backing into a slot (not shown).

One object of the invention is to provide an organizer 1 that can be offered as an advertising premium by a particular store. First, a particular store can emboss organizer 1 with its store name or logo as shown by reference numerals 52 and 54. It will be appreciated that the logo, particularly logo 54, can be the inventor's logo or the manufactuer's logo instead of the store's logo. Moreover, the shopping list or indicia 32 can be customized to correspond to the location of the common grocery store items in the advertised store so that the overall usefulness of the organizer is enhanced relative to that store. In that manner, the organizer 1 can be offered as an advertising premium to customers.

In use, organizer 1 can be opened so that the inside surfaces 21, 42 of panels 3,5 are exposed. The magnetized inner lay 19 in panel 3 allows the organizer to be removably attached to a refrigerator and also provides a firm, flat writing surface. A clean envelope 30 is placed in the envelope frame 23 with the preprinted list 32 exposed. The user then can check off items or enter quantity numbers next to a particular item on the envelope. Also, coupons are placed in the envelope 30 as accumulated. For a shopping trip, the user can remove the entire organizer from the refrigerator, fold it to a closed position and fasten the snap closure. At the grocery store, the user can follow the preprinted list and efficiently shop. At the grocery checkout, the user's coupons, bank cards, and money are conveniently at hand. Upon return home, a clean envelope 30 is exposed by removing the used envelope or inserted from a supply and organizer I is ready for the next shopping trip. Alternatively, the user can pull the marked envelope from the organizer and take only the marked envelope to the grocery store if the entire organizer contents are not needed.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

I claim:

1. A shopping organizer for organizing a shopping trip to a grocery store comprising:

a first panel and a second panel each joined along a common edge in a hinged arrangement which allows the panels to be moved from a first closed position to a second open position;

said first panel including a frame for the removable insertion of an envelope, said frame comprising only a first member and a spaced apart second member and a cross member Joining said first and second members;

a removable envelope in said frame, said removable envelope having a printed indicia of grocery items thereon and positioned to be accessible by a user when the panels are in an opened position, said indicia of grocery items printed on said envelope in a predetermined order corresponding to a location of said items in a grocery store; and fastening means between said first and second panels to secure said panels together in said closed position.

2. The shopping organizer of claim 1 wherein said first panel further comprises a magnetized inner layer for the removable attachment of the organizer to an attracted surface.

3. The shopping organizer of claim 1 wherein the second panel further comprises a plurality of storage slots.

4. The shopping organizer of claim 1 further including a writing instrument.

5. A shopping organizer comprising;

a first panel;

a second panel hingedly attached to said first panel to allow said panels to be moved from a first closed position to a second open position for use;

said first panel including a flat inner layer comprised of an inflexible material;

said first panel further including an envelope frame, said frame comprising a pair of spaced apart rigid side members and a rigid bottom member therebetween forming an open topped rigid frame;

at least one removable envelope slidingly engaged in said envelope frame, said at least one envelope having a preprinted indicia of grocery items, said at least one envelope being positioned within said frame so that said preprinted indicia of grocery items is exposed upon the movement of said panels from an closed position to an open position.

6. The shopping organizer of claim 5 wherein said second panel further includes a plurality of storage slots.

7. The shopping organizer of claim 6 wherein said second panel further includes a notepad affixed thereto.

8. The shopping organizer of claim 5 further comprising a closure to secure the panels in the closed position.

9. A shopping organizer for containing and organizing items for shopping such as a shopping list and coupons comprising:

a first panel having a flat inner layer comprised of a hard and relatively inflexible material;

a rigid, open top envelope frame on an inside surface of said first panel;

at least one envelope for the storage of coupons removably engaged within said envelope frame, said envelope further including a preprinted grocery list, said grocery list including a plurality of grocery items, said grocery list being printed on said removable envelope and arranged in a predetermined pattern corresponding to the location of said grocery items within a predetermined grocery store whereby rendering the grocery list removable from the organizer with the envelope;

a second panel hingedly connected to said first panel, said second panel including at least one storage slot formed therein;

said first and second panels being movable relative to each other from an open position wherein said grocery list on said at least one removable envelope is exposed for access to said preprinted grocery list to a closed position wherein said at least one envelope is secured between said panels.

10. The organizer of claim 9 wherein said panels are secured in said closed position by a clasp and clasp receiving means on the other edges of said panels.

11. The organizer of claim 9 wherein said magnetized layer is of sufficient magnetic strength so as to allow said organizer to be suspended from a relatively flat surface by the magnetic attraction between said magnetic layer and said relatively flat surface.

12. The organizer of claim 9 further including a writing instrument removably secured at a hinge area between said first and second panels.

13. The organizer of claim 9 wherein said preprinted list of grocery items further comprises a preprinted list of grocery items printed and arranged on said envelope in a manner corresponding to a predetermined aisle plan of a grocery store.

14. The organizer of claim 9 wherein said second panel includes at least one slot for the removable insertion of a plastic card.

15. The organizer of claim 14 wherein said organizer includes at least one embossed logo of said grocery store.

* * * * *